United States Patent [19]

Krause

[11] Patent Number: 4,474,264

[45] Date of Patent: Oct. 2, 1984

[54] COLLAPSIBLE MULTI-PURPOSE LADDER

[76] Inventor: Günther Krause, Porschestrasse 9, D-6320 Alsfeld, Fed. Rep. of Germany

[21] Appl. No.: 478,565

[22] Filed: Mar. 24, 1983

[30] Foreign Application Priority Data

Mar. 26, 1982 [DE] Fed. Rep. of Germany ..... 3211164

[51] Int. Cl.[3] ..... E06C 1/383

[52] U.S. Cl. ..... 182/163; 16/332; 16/334; 16/349; 182/22

[58] Field of Search ..... 182/163, 24, 164, 156, 182/22; 292/63; 16/332, 334, 344, 349, 324, 325

[56] References Cited

U.S. PATENT DOCUMENTS

| | | | |
|---|---|---|---|
| 764,310 | 7/1904 | Shaw | 292/63 |
| 1,532,322 | 4/1925 | Lane | 292/63 |
| 3,655,012 | 4/1972 | Hoffman et al. | 182/163 |
| 3,955,240 | 5/1976 | Schuh | 182/163 |

FOREIGN PATENT DOCUMENTS

| | | | |
|---|---|---|---|
| 2052584 | 5/1972 | Fed. Rep. of Germany | 182/163 |
| 2508573 | 9/1976 | Fed. Rep. of Germany | 182/24 |
| 2914476 | 10/1980 | Fed. Rep. of Germany | 182/163 |

*Primary Examiner*—Reinaldo P. Machado
*Assistant Examiner*—A. Chin-Shue
*Attorney, Agent, or Firm*—Flynn, Thiel, Boutell & Tanis

[57] ABSTRACT

A collapsible multi-purpose ladder has ladder stringers which are connected by joints which are arranged in pairs, can be locked in several operating positions, and each have two joint parts which are pivotal about a common joint axle. The first joint part has a two-cup locking disk which is concentric with respect to the joint axle and, along its circumference, has notches which are distributed to correspond to the various operating positions. The notches can receive a spring-loaded locking part which is guided for longitudinal movement on the second joint part, which grips over the first joint part. The locking part can be moved out of a notch of the locking disk by a release lever which is pivotally supported on the second joint part and the release levers of the two joints which are associated with the two ladder stringers are operatively connected by a rod. The locking part includes a lock member which is substantially rectangular, has a width which approximately equals the width of the second joint part, and is guided in slots in the sidewalls of the second joint part, includes a guide part having a width which is only slightly less than the inside width of the second joint part and a length which is greater than the width of the slots, and includes a guide rod for the spring. The slots are wider than the width of the lock member and each have a retaining surface which can hold the lock member in its disengaged position. The locking disk which has the notches has noses which face in the same direction, a respective nose lying next to each notch and forming a stop surface for the lock member.

9 Claims, 13 Drawing Figures

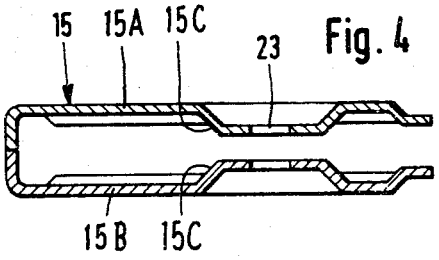
Fig. 4
Fig. 2
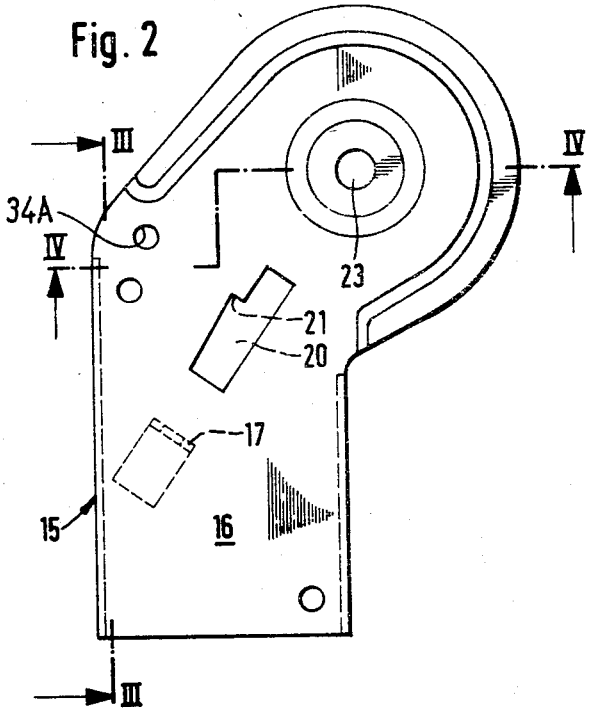
Fig. 3
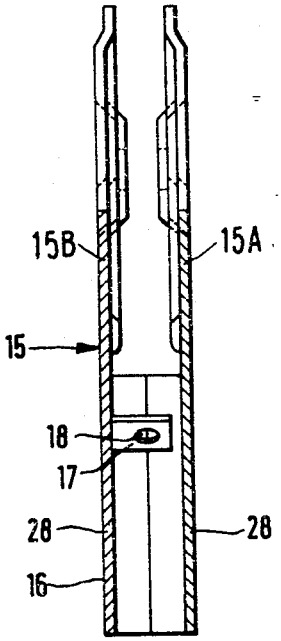

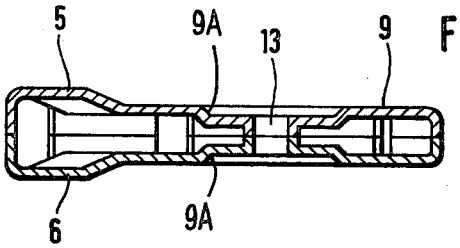
Fig. 7
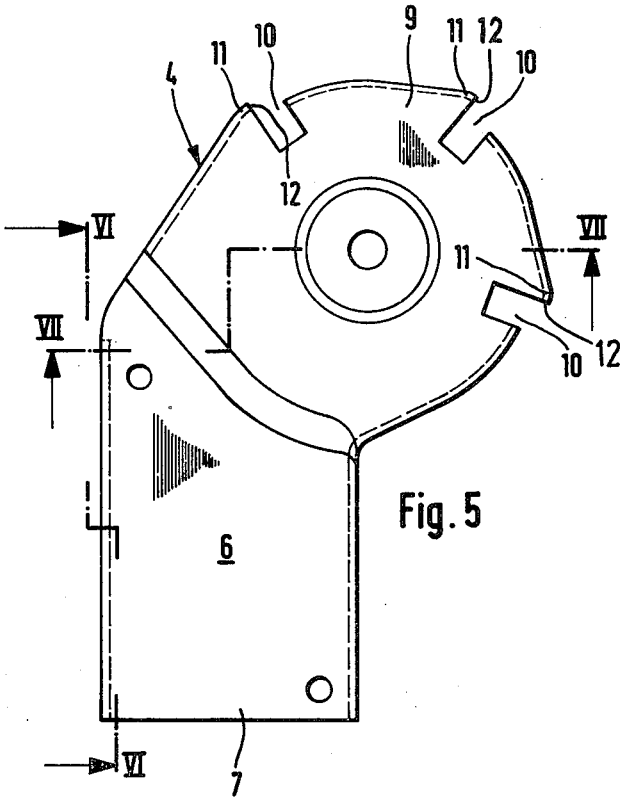
Fig. 5
Fig. 6
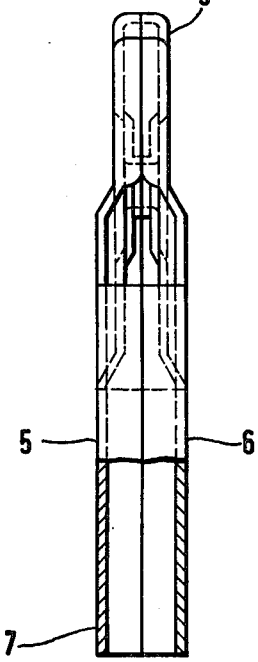

COLLAPSIBLE MULTI-PURPOSE LADDER

FIELD OF THE INVENTION

This invention relates to a collapsible ladder and, more particularly, to a ladder having two stringers which are supported for relative pivotal movement and can be releasably locked in various angular positions with respect to each other.

BACKGROUND OF THE INVENTION

The invention relates to a collapsible multi-purpose ladder, the ladder stringers of which are connected by joints which are arranged in pairs and are releasably lockable in several operating positions. The joints each have two joint parts which are pivotal about a common joint axle. A first joint part has a two-cup locking disk which is concentric with respect to the joint axle and, along its circumference, has notches which are distributed to correspond to the respective operating positions. The notches can receive a spring-loaded locking part which is guided for longitudinal movement on the second joint part, which grips over the first joint part. The locking part can be moved out of a notch of the locking disk by a release lever which is swingably supported on the second joint part, the release levers of the two joints being connected by a rod. Such a multi-purpose ladder is known from German Offenlegungsschrift No. 27 54 755.

The connecting rod of this ladder extends inside a ladder stringer, whereby the operation of the release lever occurs with control grips which are arranged on the sides of the ladder stringers. This conventional joint arrangement is structurally expensive to manufacture and is susceptible to breakdown during operation.

A basic purpose of the invention is to provide a collapsible multi-purpose ladder of the above-mentioned type in which the joints are structurally simple and the ladder can be operated easily.

SUMMARY OF THE INVENTION

This purpose is attained by providing on the locking part a rectangular lock member which has a width which approximately equals the width of the second joint part and is guided in slots provided in the sidewalls of the second joint part, a guide part which is connected to the lock member, has a width which is only slightly less than the inside width of the second joint part, and has a length which is greater than the width of the slots, and a guide rod for the spring. The slots are wider than the thickness of the lock member and include retaining surfaces which can hold the lock member in its disengaged position. The locking disk which has the notches also has noses which face in the same angular direction, each nose lying next to a respective notch and defining a stop surface engageable with the lock member of the locking part.

This inventively constructed joint for a collapsible multi-purpose ladder requires only a few parts, and the locking part is arranged so that it is guided both in a lateral direction and also in a lengthwise direction. The lengthwise guiding is taken over by the lock member, which has the same width as the second joint part and is slidably guided in slots in the same. The guiding is here obtained through the edges of the slots in lateral walls of the second joint part. Each slot has an enlargement which defines a retaining surface for the tip of the lock member. The lock member can be moved out of a notch with the help of a release lever which also moves the lock member slightly laterally, so that it rests on the retaining surface and is kept out of engagement with the notches. This means that the release lever, during pivoting of the ladder stringers about the joint axle, does not need to be operated again. By constructing noses next to the notches which form stop surfaces engageable with the lock member, it is assured that, upon reaching the next notch, the lock member will be moved away from its retaining surfaces by the stop surface and will automatically be moved by the spring into engagement with the notch. Since the retaining surfaces for the lock member of the locking part are arranged on one side of the slots, the lock member will be moved off the retaining surfaces by the stop surfaces only for a certain direction of relative rotation of the ladder stringers. The noses and retaining surfaces are arranged so that, during collapsing of the ladder stringers, the locking part is kept from entering the notches, so that after a single operation of the release lever, the ladder can be collapsed completely. During extending of the ladder, however, the locking parts of the joints which are arranged in pairs always engage the next notch with which they become aligned after the release lever is released. Through this, a simple handling of the ladder is achieved.

According to a further embodiment of the invention, the rod which connects the two release levers extends laterally next to a rung which is adjacent the joints. This has the advantage that, for operation, with one and the same grip the ladder can be held and the release mechanism can be operated, which makes handling extremely simple.

For safety reasons, the extended position of the ladder stringers is also secured by engagement of the locking part in a suitably arranged notch. Through this, it is achieved that the ladder stringers can also in this position lie spaced from one another, so that serious injuries which have previously occurred and which have resulted in the squeezing off of fingers can no longer occur.

BRIEF DESCRIPTION OF THE DRAWINGS

One exemplary embodiment of the invention will be described in greater detail hereinafter in connection with the drawings, in which:

FIG. 2 is a side view of a joint part which is a component of the joint of FIG. 1;

FIG. 3 is a cross-sectional view taken along the line III—III of FIG. 2;

FIG. 4 is a cross-sectional view taken along the line IV—IV. FIG. 2;

FIG. 5 is a side view of a further joint part which is a component of the joint of FIG. 1;

FIG. 6 is a cross-sectional view taken along the line VI—VI of FIG. 5;

FIG. 7 is a cross-sectional view taken along the line VII—VII of FIG. 5;

DETAILED DESCRIPTION

Figure 1:
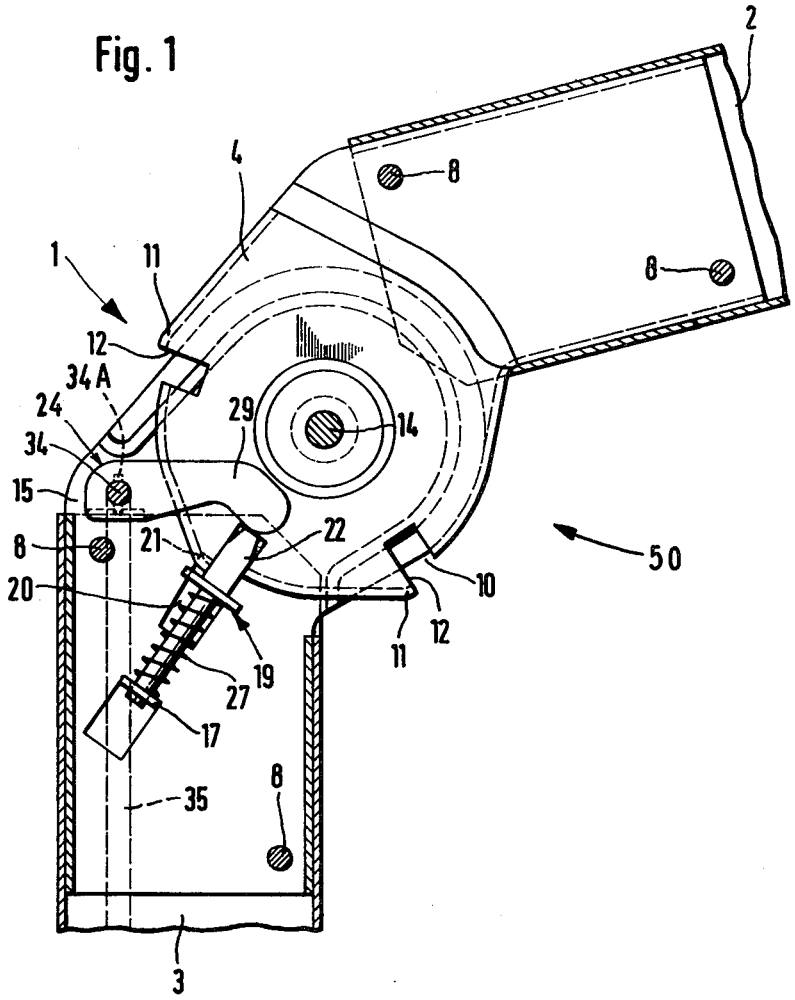
FIG. 1 is a fragmentary cross-sectional side view of a joint of a collapsible multi-purpose ladder which embodies the present invention.

FIG. 1 illustrates a joint 1 of a collapsible multi-purpose ladder 50. The joint 1 pivotally couples two ladder stringers 2 and 3 of the multi-purpose ladder 50. The joint 1 includes a first joint part 4 which is illustrated in FIGS. 5 to 7.

The first joint part 4 is composed of two symmetric halves 5 and 6, which are each formed of sheet metal, and has a guide part 7 which has an outer contour which corresponds with the inside contour of the associated ladder stringer 2. The first joint part 4 extends into the ladder stringer 2 with its guide part 7, as is illustrated in FIG. 1. The ladder stringer 2 and the guide part 7 are secured together with the help of rivets 8. The joint part 4 also includes a locking disk 9 which is smaller in thickness than the guide part 7. The locking disk 9 has several radially extending notches or slots 10 which are arranged at spaced angular locations along the periphery thereof, so that the ladder stringers 2 and 3 can be releasably fixed with respect to one another by a mechanism described hereinafter in positions in which they form angles of 90°, 135° and 180°.

A radially outwardly projecting nose 11 is provided on one side of each of the notches 10 in the locking disk 9, which noses 11 each define a circumferentially facing stop surface 12. The noses make one side of each notch 10 longer than the other side thereof. The noses 11 are each formed on the same side of the respective notches 10 so that, as will be discussed later on, they cooperate only in one direction of rotation with a locking part 19 (FIG. 1) which effects the releasable locking. The locking disk 9 has in its center an opening 13 for receiving a joint axle 14 (FIG. 1). In the region of the opening 13, the walls of the locking disk 9 are pulled in, so that a better guiding is obtained for the second joint part 15, which is illustrated in detail in FIGS. 2 to 4.

The second joint part 15 has, like the first joint part 4, a guide part 16 which extends into the ladder stringer 3 and is secured therein by means of rivets 8. A flange 17 is formed from the material of the guide part 15 and is bent inwardly. The flange 17 has an opening 18 therein which serves to guide the locking part 19. The guide part 16 also has, in opposite walls thereof, aligned slots 20 which extend radially of the axle 14 (FIG. 1) and have retaining surfaces 21 partway along one side thereof which face away from the axle 14. Each retaining surface is, as can be seen from FIG. 1, arranged relative to the notches 10 so that it lies radially outwardly of the outer edge of the notch which is opposite the nose 11 but radially inward of the tip of the nose 11, so that in one direction of rotational movement the stop surface 12 will cooperate with a lock member 22 of the locking part 19 as described hereinafter.

The second joint part 15 also has an opening 23 for the joint axle 14, the disk 9 of joint part 4 being rotatably supported on axle 14 between spaced walls 15A and 15B of the joint part 15. Furthermore, as can be seen from FIG. 4, the walls 15A and 15B are bent inwardly in the region of the opening 23, so that cooperating annular guide surfaces 9A (FIG. 7) and 15C are defined and assist the joint axle 14 in centering the two joint parts 4 and 15.

Figure 9:
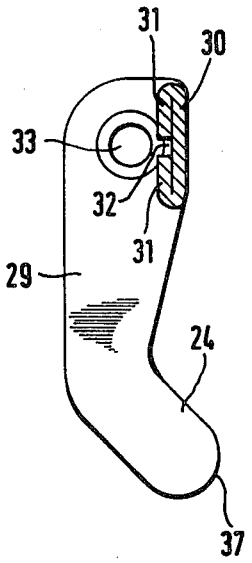
FIG. 9 is a cross-sectional view taken along the line IX—IX of FIG. 8.
Figure 8:
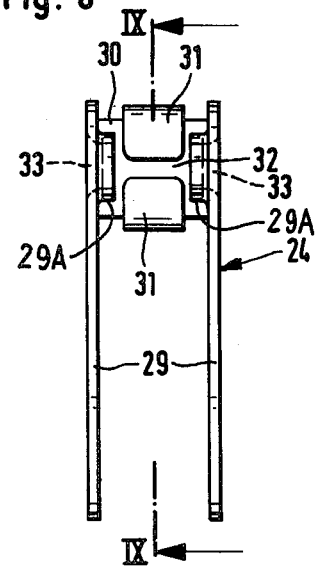
FIG. 8 is a top view of a release lever which is a component of the joint of FIG. 1.

The second joint part 15 also has an opening 34A (FIG. 2), through which extends an axle 34 (FIG. 1) for the release lever 24, which is illustrated in detail in FIGS. 8 and 9.

Figure 11:
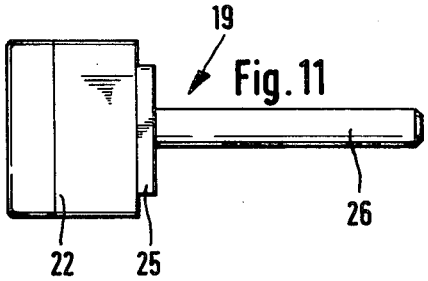
FIGS. 10 to 12 are respectively a side view, a top view and an end view of a locking part which is a component of the joint of FIG. 1.
Figure 12:
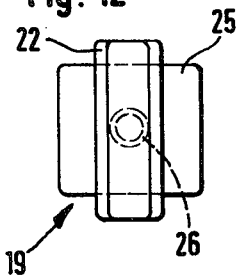
Figure 10:
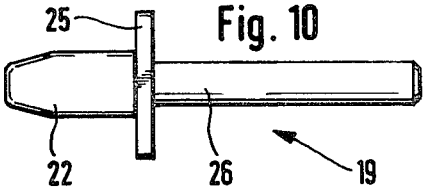

FIGS. 10 to 12 illustrate the locking part 19. The locking part consists of a rectangular lock member 22 which can engage the notches 10 in the locking disk 9. A transversely extending guide part 25 is provided adjacent the lock member 22, and on the guide part 25 is provided a rod 26 which serves as a guide for a compression spring 27 (FIG. 1). The thickness of the lock member 22 is slightly less than the width of the notches 10, whereas the width of the lock member 22 is substantially equal to the external width dimension of the guide part 16 of the second joint part 15 in the region of the slots 20. Lengthwise guiding of the lock member 22 is thus effected by the edges of the slots 20 in the sidewalls 28 of the guide part 16 of the second joint part 15.

As can be seen from FIG. 11, the width of the guide part 25 which is connected to the lock member 22 is less than that of the lock member 22 by approximately twice the thickness of one of the sidewalls 28, so that portions of the lateral edges of guide part 25 rest on the inner surfaces of the sidewalls 28. In this respect, the length of the guide part 25 is substantially greater than the thickness of the lock member 22 and the width of slots 20, so that the guide part 25 of locking part 19 is slidably supported against sidewalls 28 on opposite sides of the slots 20. The rod 26 extends, as can be seen from FIG. 1, slidably through the opening 18 in the flange 17. Between the flange 17 and the guide part 25 there is arranged a compression spring 27, which encircles rod 26 and presses the lock member 22 in the direction of the notches 10.

The release lever 24 is made from a bent piece of sheet metal, is pivotally supported on the second joint part 15 by axle 34, and is illustrated in detail in FIGS. 8 and 9. The release lever 24 is provided with two axially spaced, radially extending arms 29 which are disposed on opposite sides of the disk 9 (FIG. 1) and are connected by a web 30. Two tabs 31 which are arranged laterally on the web 30 are bent over the web 30 (FIG. 9) and, between the tips of the tabs 31, there remains a small gap 32. The arms 29 each have an opening 33 which has slightly inwardly drawn walls at 29A for better guiding of the axle 34 which supports and operates the release lever 24. The axle 34 has, in the region of the release lever 24, lateral projections on opposite sides thereof, as at 34A (FIG. 1), one of which extends into the gap 32 and engages tabs 31 so that the release lever 24 is fixed against rotation with respect to the axle 34.

Figure 13:
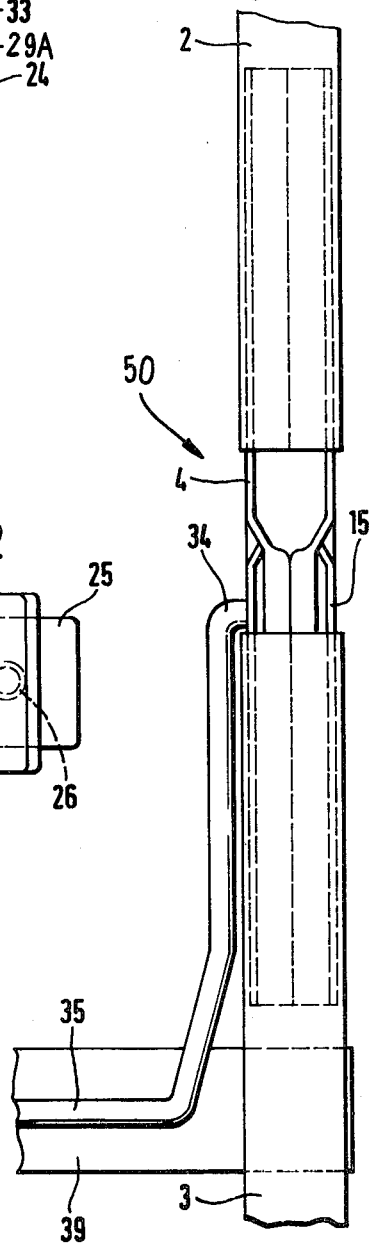
FIG. 13 is a fragmentary top view of the ladder and joint of FIG. 1.

As shown in FIG. 13, the axle 34 is one end of a rod 35 which is substantially U-shaped and connects the axle 34 to the corresponding axle of the joint on the opposite side of the ladder 50. The rod 35 extends laterally along a rung 39, so that it lies outside the stepping region and will not be inadvertently actuated.

OPERATION

The joint 1 operates as follows. By lifting up the rod 35, axle 34 is rotated and the release lever 24 is moved downwardly and presses with bearing surfaces 37 provided at the ends of legs 29 against the lock member 22 of the locking part 19 on opposite sides of the disk 9 and moves the lock member 22 out of the groove 10 against the force of spring 27. Through the movement of the lever 24, the locking part 19 and thus the lock 22 thereof are urged toward the axle 34 of the lever 24, so that the lock member 22 is moved to a position in which its tip rests on the retaining surfaces 21. The rod 35 and lever 24 can then be released and the stringers 2 and 3 can be rotated relative to each other. If the rotation of stringer 2 takes place in a clockwise direction in FIG. 1, the ladder stringer 2 can, without causing the lock 22 to move into one of the notches 10, be moved into a position adjacent and parallel to the ladder stringer 3. If, however, the ladder stringer 2 is rotated counterclockwise in FIG. 1, the stop surface 12 on the first of the noses 11 to reach lock member 22 will engage the lock member 22 and move it in a direction away from the axle 34 so that it is disengaged from the retaining surfaces 21 and, due to the force of the spring 27, moves into the notch 10 and locks the movability of the ladder stringers 2 and 3 relative to one another.

The joint according to the invention is distinguished by a simple design, substantial operating safety and simple operation. The locking mechanism includes a spring and a locking part which is guided in the second joint part and can be operated by a simply designed lever, whereby the release levers of two associated joints can be operated simultaneously so that only one release operation is necessary. Since, in addition, the rod 35 which is connected to the axle 34 for the release lever 24 is arranged in the area of the rung 39, it is possible for a desired extension or collapsing of the ladder and operation of the release lever to occur practically simultaneously, which brings about a substantial simplification of the operation.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A collapsible ladder, comprising elongate first and second stringers and coupling means for pivotally coupling an end of said first stringer to an end of said second stringer so as to facilitate relative pivotal movement of said stringers about a pivot axis, said coupling means further being adapted to releasably lock said first stringer against pivotal movement relative to said second stringer in a plurality of predetermined positions which are angularly spaced;

wherein said coupling means includes a locking disk which is fixedly supported on said first stringer substantially concentric with said pivot axis, which has means defining a plurality of angularly spaced notches in a peripheral edge portion thereof, and which has a plurality of radially outwardly projecting noses provided on said peripheral edge portion thereof, each said notch having a respective said nose on one side thereof and each said nose having on a side thereof facing the associated notch a stop surface which faces circumferentially in a first direction of rotation with respect to said pivot axis; a lock member; guide means supporting said lock member on said second stringer for movement along a path of movement extending approximately radially of said pivot axis between a first position and a second position located radially inwardly of said first position, and for limited transverse movement away from said path of movement in a second direction substantially opposite said first direction when said lock member has moved at least a predetermined distance from said second position, said guide means including means for preventing movement of said lock member about said pivot axis. relative to said second stringer when said lock member is in said second position, and means for preventing movement of said lock member toward said pivot axis past a third position when said lock member is transversely spaced from said path of movement, and said lock member being spaced radially outwardly from said locking disk and from said noses thereon when in said first position, being radially aligned with and received in a respective one of said notches in said locking disk when in said second position and when said stringers are in one of said predetermined positions, and having a radially innermost portion which is spaced radially outwardly of said locking disk and radially inwardly of the radially outermost portions of said noses on said locking disk when said lock member is in said third position; resilient means for yieldably urging said lock member approximately toward said pivot axis; and manually operable actuating means for moving said lock member away from said pivot axis against the urging of said resilient means and transversely away from said path of movement in said second direction; and wherein rotation of said locking disk and first stringer in said second direction relative to said second stringer following an actuation and release of said actuating means keeps said lock member spaced transversely from said path of movement, each said nose passing said locking member causing said lock member to move radially outwardly away from said third position against the urging of said resilient means and said resilient means thereafter returning said lock member to said third position; and wherein rotation of said locking disk and first stringer in said first direction relative to said second stringer following an actuation and release of said actuating means causes said stop surface on the first said nose passing said lock member to engage said lock member and move it transversely to said path of movement, said resilient means then urging said lock member into said second position in which it operatively engages the notch adjacent such nose and prevents further relative pivotal movement of said stringers.

2. The ladder according to claim 1, wherein said second stringer has a first wall in the region of said lock member which extends approximately radially of said pivot axis; wherein said guide means includes means defining a slot in said first wall which extends approximately radially of said pivot axis, said slot having a first portion at the radially inner end thereof which is of lesser width than a second portion at the radially outer end thereof, and having a shoulder between said first and second portions thereof which faces away from said pivot axis; and wherein a portion of said lock member is slidably received in said slot, said lock member being in said second position when said portion thereof is at the radially inner end of said slot and being in said first position when said portion thereof is at the radially outer end of said slot, said shoulder of said slot being engageable with said portion of said lock member and being said means for preventing movement of said lock member toward said pivot axis past said third position.

3. The ladder according to claim 2, wherein said second stringer includes a second wall which is spaced from and substantially parallel to said first wall; wherein said guide means includes means defining a slot in said second wall which is aligned with and substantially identical to said slot in said first wall; wherein said lock member is slidably supported between said first and second walls, has a thickness slightly less than the width of said first portion of said slots, and has a width greater than the distance between said first and second walls, opposite side portions of said lock member each being slidably disposed in a respective said slot; and including a platelike guide part which is fixedly supported on a side of said lock member remote from said pivot axis and extends generally transversely of said path of movement of said lock member, said guide part having a width which is approximately equal to the distance between said first and second walls and a length which is greater than the width of said second portion of each said slot.

4. The ladder according to claim 3, including a pin fixedly supported on said guide part and extending outwardly therefrom in a direction away from said pivot axis; means defining a flange on one of said first and second walls approximately perpendicularly thereto and means defining an opening in said flange, a portion of said pin remote from said lock member being slidably received in said opening in said flange; and wherein said resilient means includes a helical compression spring which encircles said pin on said lock member and has one end supported on said guide part and its other end supported on said flange.

5. The ladder according to claim 3, wherein said actuating means includes an axle extending between and supported on said first and second walls of said second stringer and a release lever pivotally supported between said first and second walls on said axle and engageable with said lock member, said shoulders in said slots being provided on the sides of said slots which are nearest to said axle.

6. The ladder according to claim 3, wherein said locking disk includes two cup-shaped parts which are disposed against each other and are disposed between said first and second walls; and wherein said cup-shaped parts and said first and second walls each have a circular indentation concentric with said pivot axis, said circular indentation on each of said first and second walls having a radially outwardly facing annular surface thereon which slidably engages a radially inwardly facing annular surface on said circular indentation on a respective one of said cup-shaped parts.

7. The ladder according to claim 1, wherein said actuating means includes a lever supported on said second stringer for pivotal movement about an axis which is spaced from said lock member and is substantially parallel to said pivot axis, said lever having a portion spaced from said pivot axis thereof which is engageable with the radially innermost portion of said lock member; and including means for effecting pivotal movement of said lever in a direction causing said portion thereof to engage said lock member and move said lock member away from said pivot axis of said stringers against the urging of said resilient means.

8. The ladder according to claim 7, wherein said actuating means includes an axle coaxial with said pivot axis of said lever, rotatably supported on said second stringer, having means defining a radial projection thereon and having said lever supported thereon; wherein said lever is made from a piece of U-shaped sheet metal having two spaced arms connected by a web, each said arm having an opening therein adjacent said-web through which said axle extends; and including two tabs on opposite sides of said web of said lever which are bent to extend toward each other adjacent and parallel to said web, the adjacent ends of said tabs being spaced slightly and said projection on said axle being disposed between the adjacent ends of said tabs.

9. The ladder according to claim 7, wherein each said ladder stringer includes two spaced rails and a plurality of rungs extending between said rails at spaced locations therealong, each said rail of said first stringer being pivotally coupled at said end thereof to a respective rail of said second stringer at said end thereof by a respective said coupling means; and including a U-shaped rod having a bight and two spaced, parallel legs, an end portion of each said leg remote from said bight being bent to extend away from the other leg substantially parallel to said bight, each said end portion of said rod extending through and being rotatably supported in a respective said rail of said second stringer and being an axle on which one of said release levers is nonrotatably supported, said bight of said rod normally being adjacent and parallel to one of said rungs of said second stringer, movement of said bight away from such rung effecting rotation of said release lever of each said coupling means in a direction effecting movement of said lock members thereof away from said pivot axis of said stringers.

* * * * *